US006311865B1

(12) United States Patent
Laurent

(10) Patent No.: US 6,311,865 B1
(45) Date of Patent: Nov. 6, 2001

(54) ARRANGEMENT FOR RESEALING CARBONATED BEVERAGE CONTAINERS

(76) Inventor: Hervé J. Laurent, 1610 Granville Ave., Los Angeles, CA (US) 90025

( * ) Notice: Subject to any disclaimer, the term of this patent is extended or adjusted under 35 U.S.C. 154(b) by 0 days.

(21) Appl. No.: 09/660,686

(22) Filed: Sep. 13, 2000

Related U.S. Application Data

(63) Continuation of application No. 09/221,461, filed on Dec. 28, 1998, now Pat. No. 6,155,452.

(51) Int. Cl.[7] ..... B65D 77/00

(52) U.S. Cl. ..... 220/739; 220/711; 220/713; 220/737

(58) Field of Search ..... 220/711, 713, 220/737, 739, 592.17, 592.24, 740, 904

(56) References Cited

U.S. PATENT DOCUMENTS 4,054,205 * 10/1977 Blow, Jr. et al. ..... 220/711 X
4,600,111 * 7/1986 Brown ..... 220/737 X
4,790,444 * 12/1988 Terzi ..... 220/714
4,883,192 * 11/1989 Krugman ..... 220/711
5,071,042 * 12/1991 Esposito ..... 220/711 X
5,176,278 * 1/1993 Quarberg ..... 220/711 X
5,261,554 * 11/1993 Forbes ..... 220/739 X
5,947,324 * 9/1999 Palinchak ..... 220/713
6,155,452 * 12/2000 Laurent ..... 220/739

* cited by examiner

*Primary Examiner*—Steven Pollard
(74) *Attorney, Agent, or Firm*—Notaro & Michalos P.C.

(57) ABSTRACT

A cap arrangement reseals a beverage container having a top with an aperture that can be opened to discharge the beverage and a rim with an inner surface around the top, in particular, carbonated soda can. The arrangement has a main cap for engagement over the beverage container top, for covering the beverage container top, a seal member connected hermetically to the main cap and extending toward the beverage container top and a locking mechanism connected to the main cap for fixing the main cap to the beverage can with sufficient force to resist pressure from, and to maintain pressure in the beverage container. The seal member has an annular pressure sealing portion adapted to engage against, and hermetical seal with the inner surface of the beverage container rim. The arrangement may also include an enclosure for receiving the beverage container. The enclosure may be insulated and form part of the locking mechanism which may be screw threads between the main cap and the enclosure.

11 Claims, 8 Drawing Sheets

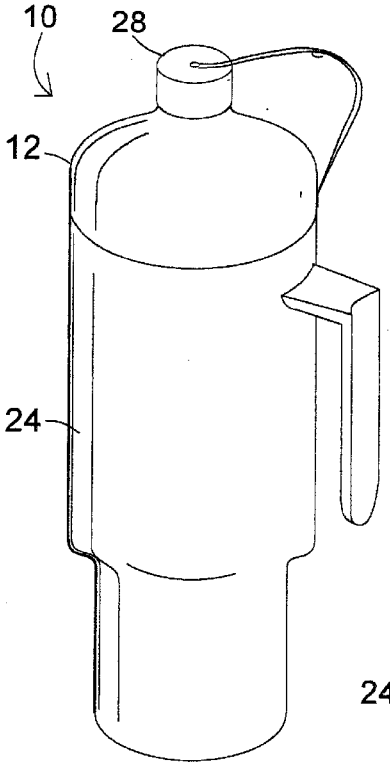
FIG. 1
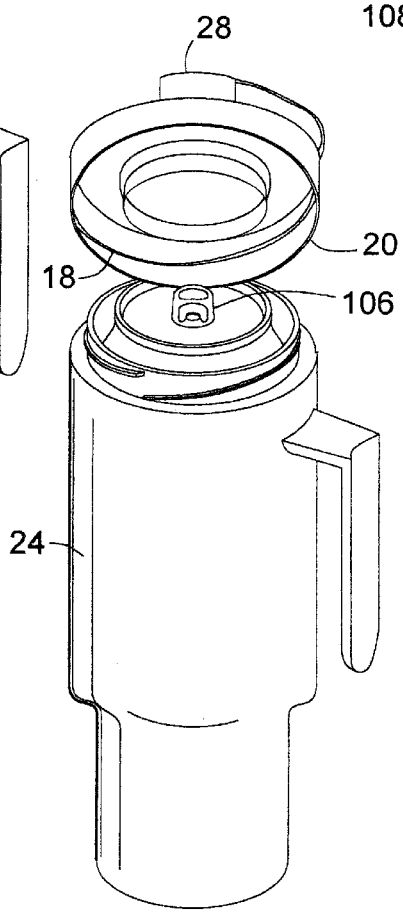
FIG. 3
FIG. 2
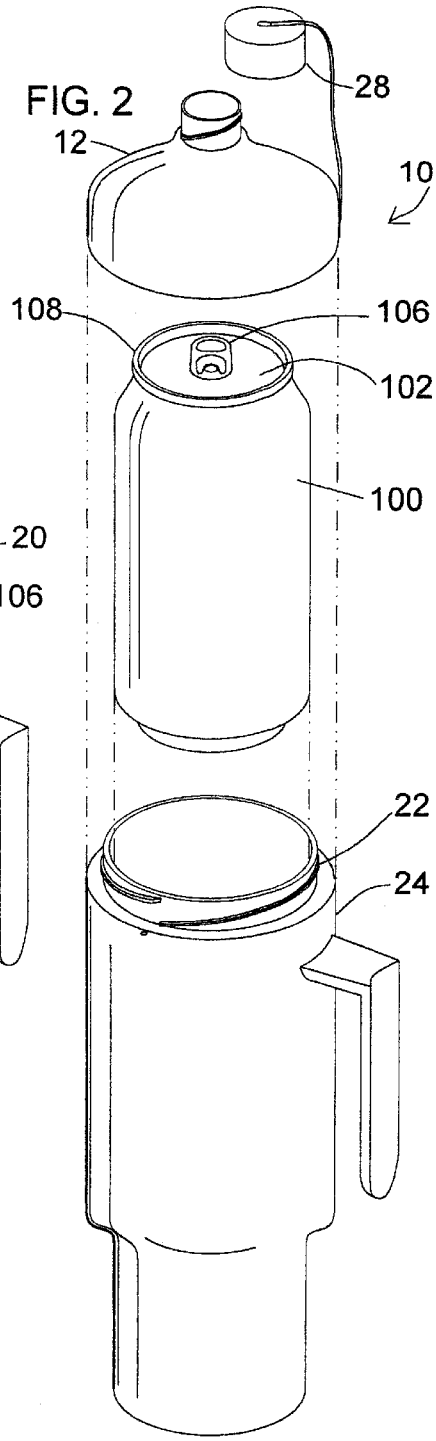

ARRANGEMENT FOR RESEALING CARBONATED BEVERAGE CONTAINERS

This application is a continuation of application Ser. No. 09/221,461, filed Dec. 28, 1998, now U.S. Pat. No. 6,155,452.

FIELD AND BACKGROUND OF THE INVENTION

The present invention relates in general to beverage containers, and in particular to a new and useful arrangement for resealing a beverage container such as a carbonated soda can.

Aluminum cans have been used to contain carbonated, pressurized soda, beer or other pressurized beverages as well as non-carbonated drinks for many years. Initially, the cans were opened using a can opener which cut a triangular hole into the upper surface of the can near its rim. Later, tab openers were developed which included a tab connected to a portion of the can cover, surrounded by a weakening. The tab was pulled to dislodge the portion, thus exposing an opening. Tabs were discarded and posed a litter problem. The technology developed further to produce attached tabs which were used as levers to rupture a peripheral weakening and push a section of the can top down into the can. The tab ripped away a portion of the can top and permanently attached itself to the can so that the can with its tab and top could be discarded or recycled as a unit.

Although such cans are normally thought of as single-use products, various devices have been developed to re-close the can to allow it to be re-used at some future time. These devices generally failed to reseal the can and preserve carbonization. Some merely re-close the can opening to avoid contamination. A typical example is disclosed in U.S. Pat. No. 5,125,525 to Tucker.

One other example of the prior art is illustrated in FIG. 11. As shown in FIG. 11, an aluminum can 100 includes an aluminum top 102 which is connected to a sidewall of the can through an upstanding rim 108, having an inner surface 110 and an outer bead 112. The prior art re-closing device comprises a main cap 120 made of durable plastic and having a central opening 122 with a thread 124 that can receive a secondary cap (not shown). Main cap 120 includes, at one side thereof, a fixed hook 126 which engages under the bead 112. A rotatable hook member 128 has a central opening 130 mounted for rotation around a central stem in the main cap 120 which contains the central opening 122. Hook member 128 includes a hook portion 132 which engages under bead 112 at a location opposite from the hook portion 126. To engage the prior art device, hook member 128 is pivoted around the axis of the cap as shown by the curved arrow X, to bring the hook portion 132 of the hook member 128 around and close to the hook portion 126 of the main cap 120. This permits both hooks to engage under the bead 112. The hook member 128 is then rotated to swing hook member 132 to the opposite side of the can, thus engaging the opposite sides of the bead 112 and fixing the main cap to the can. To help preserve the pressure in the can, a resilient seal 136, having an L-shaped cross section was fixed below main cap 120 and pressed down against the upper surface of can top 102.

Several problems were experienced by the prior art structure. Firstly, the hooks 126, 132 tended to disengage from the rim after some pressure had built up, thus raising the cap off the can. Secondly, if the hook did not disengage rapidly as in the first case, the pressure in the can tended to leak past the seal 136 anyway. The construction and position of the main cap and seal tended to "fight" the gas pressure in the can and generally lost the battle.

In addition, although the mechanism is clever, the way to use hook number 128 is not visually obvious, thus requiring specific instructions to operate the device.

A need remains for a simple and effective mechanism for resealing a carbonated beverage container.

SUMMARY OF THE INVENTION

An object of the present invention is to provide an arrangement for resealing a beverage container having a top with an aperture that can be opened to discharge the beverage and a rim with an inner surface around the top, in particular, carbonated soda container. The arrangement has a main cap for engagement over and for covering the beverage container top, a seal member connected to the main cap and extending toward the beverage container top and a locking mechanism connected to the main cap for fixing the main cap to the beverage container with sufficient force to resist pressure from, and to maintain pressure in the beverage container. The seal member has an annular pressure sealing portion adapted to engage against, and hermetical seal with the inner surface of the beverage container rim.

Another object of the invention is to provide an enclosure for receiving the beverage container. The enclosure may be insulated and form part of the locking mechanism which may be screw threads between the main cap and the enclosure.

Another object of the invention is to form the locking mechanism as latch means on the main cap for engaging the bead around the beverage container rim.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a top perspective view of a first embodiment of the present invention;

FIG. 2 is a top perspective and exploded view of the embodiment of FIG. 1;

FIG. 3 is a view similar to FIG. 1 showing how the main cap of the present invention can be used to lift a soda can tab;

DESCRIPTION OF THE PREFERRED EMBODIMENT

Figure 5:
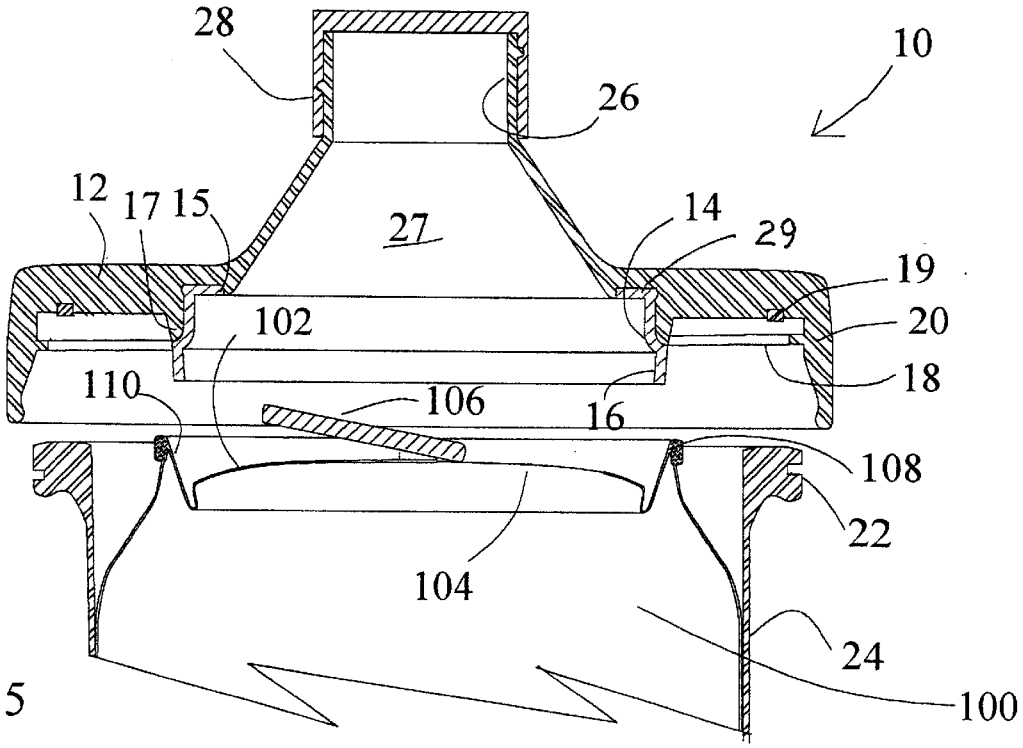
FIG. 5 is a partial sectional view of an upper portion of the device of the present invention with a can to be resealed.

Referring to the drawings in particular, the invention embodied in FIG. 5 is an arrangement generally designated 10, for resealing a beverage container such as a carbonated soda can 100, having a top 102 with an aperture 104 that can be opened, for example, by lifting a tab 106, to discharge the beverage, and a rim 108 with an inner surface 110, around the top 102. The arrangement 10 comprises a main cap 12 of durable plastic such as polyethylene, polysulfone, nylon or other plastic which is washable and suitable for foods. The main cap is for engagement over, and at least completely covering the beverage container top 102. The arrangement of the invention also includes an annular seal member 14 that is hermetically connected to the main cap 12 and which is extending downwardly toward the beverage container top 102. The seal member has an annular pressure sealing portion 16 adapted to engage against, and hermetical seal with the inner surface 110 of the beverage container rim 108, for creating a hermetic chamber 27 to reseal the aperture 104.

Locking means are connected to the main cap for fixing the main cap to the beverage container with sufficient force to resist pressure from, and to maintain pressure in the beverage container. In the embodiment of FIG. 5, the locking means are a male thread 18 on the inner surface of a lip 20 extending downwardly from the outer perimeter of cap 12, and a female thread 22 at the open upper end of an enclosure 24 which has an inner space for closely receiving the body of soda can 100. The threads 18, 20 are selected to be large enough, depending on the strength of the plastic material of the cap 12 and enclosure 24, to accommodated and restrain the gas pressure from soda can 100, which may rise to 50 psi, at least, (3.5 kg/sq cm) and thus produce a force of at least 150 lbs. (68 kg) on the main cap from a typical soda can top 102 having a 2 inch (5 cm) diameter. Another feature of the invention is an opening 26 through the main cap 12 for discharging beverage from the beverage container or soda can 100, and a secondary cap 28 removably engaged with the main cap, for example by threads, for closing the opening with sufficient force to resist pressure from, and to maintain pressure in the beverage container. Since the small cap 28 has far less surface area than the main cap 12, the threads need not be as strong to still resist gas leakage and keep the soda or other carbonated beverage from going "flat." This hermetic sealing can be accomplished many different ways. For example, the conventional cap of a pressurized plastic soda bottle can be utilized for the secondary cap 28 and its threaded opening 26.

Although threads are used in the embodiment of FIG. 5, other locking means such as latches, bayonet closures and the like can be used. Also, the threads can be reversed e.g. male on the main cap and female on the closure.

FIG. 5 also illustrates the use of an O-ring, or similar structure 19 fixed to the upper inner surface of cap near the rim 20 which, when threads 18 are fully engaged with threads 22, presses down on the top of the container 24, improving thermal insulation of the can. This also insures hermetic sealing of the enclosure with the main cap, thereby allowing the additional function of a regular THERMOS (a trademark) type container, including keeping hot beverages hot, and cold beverages cold.

Main cap 12 can be made of one part or multiple parts. Where multiple parts are used, outer portions of the main cap can be of increased insulating R value again to improve the insulating characteristics of the overall enclosure.

Depending from the inner central region of cap 12 is a downward projection or inner rim 17 which, as will be explained in greater detail with the aid of FIGS. 7A to 7D, backs up at least part of the seal 16 and has an outer surface that actually extends down into the rim 108 and near the upper portion of inner surface 110 above the seal.

Figure 4:
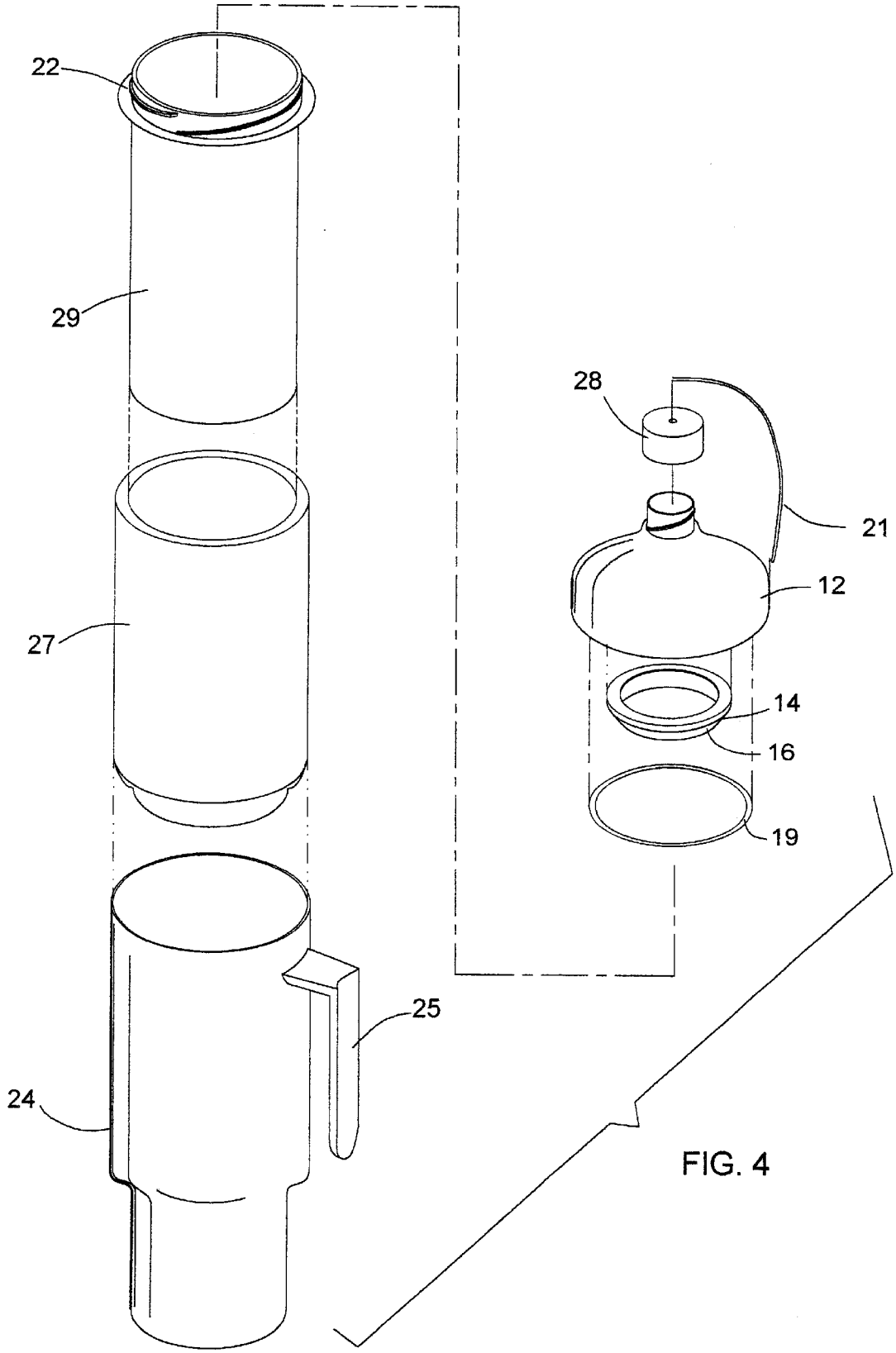
FIG. 4 is an exploded top perspective view of the embodiment of FIG. 1 showing additional parts of one possible embodiment of the invention.

Turning now to FIGS. 1–4 which illustrate other aspects of the first embodiment of the invention, container 24 may be made of one piece of plastic or other appropriate material, but can be multiple parts as shown in FIG. 4 to improve the insulation value. For example, container 24 can include an outer plastic shell with a handle 25. This shell receives an insulating insert 27 which can be foam insulation material or other appropriate insulating structure. Insulating member 27 is hollow and receives an inner shell portion 29 which has an outer diameter which closely fits the inner diameter of member 27, and an inner diameter which is optionally only slightly larger than the outer diameter of typical soda can 100. In this way, the soda can slides smoothly into the open top of the shell 29 as air escapes from around the can, thus preventing spillage of the drink in case the can has been opened before being installed into the enclosure. As illustrated in FIG. 4, the lower part of container 24 may optionally be smaller in diameter so that to fit the cup holders that are standard in most cars. Many types of insulating material can be used in conjunction with the invention (and are not critical to the invention). The only requirement critical to the invention regarding the enclosure is that the inner shell be strong enough to allow only a minimum deformation when the force of at least 150 psi resulting from the build up of the pressure tends to separate the main cap from the inner shell.

A variety of manufacturers have existing insulating containers which can be adapted to the present invention, including companies such as Rubbermaid, Coleman, Igloo, or Thermos, which specializes in vacuum type insulation. These companies all have various types of coolers with many different insulating means that can be adapted to the present invention.

Another feature of the invention is a strap 21 which has a lower end that is fixed, for example, by plastic welding to the cap 12 and connected by a rotatable connection, e.g. a washer shape at the upper end of the stripe, around a rivet on the secondary cap 28. This prevents loss of the secondary cap.

The lower edge of outer rim 20 can also be shaped so that it can be used as a tool to lift the tab 106 as shown in FIG. 3, sometimes a difficult task especially if attempted by a woman with long nails. According to a still further embodiment of the invention, a grate may be provided in the opening 26 (FIG. 5) to prevent insects from flying into the soda can. An example of the grate is illustrated in connection with FIG. 9A.

In FIG. 1, main cap or lid 12 is shown to extend only to about the level of the top of the can to be reclosed. The inventor also contemplates a lid which extends down further, however, and actually forms part of the container. For example, the lid may extend down to about the midway point along the height of the container. In an extreme case, the lid may extend all the way to the floor of the container with only the bottom being removably connected to the lid. The main purpose is to hold the lid down firmly on the top of the soda can.

Returning to FIG. 5, seat 14, with its lower sealing portion 16 also has an upward inwardly extending flange portion 15 which, with an upper portion of the seal co-extrusion, that can be attached, for example, by glueing, welding or in other ways to the inner surface of inner rim 17. The seal 14 may be made of appropriate resilient sealing material, including different plastics or synthetic rubber, for instance the synthetic material known as DAVORENE. The same material can be used for the O-ring 19. The seal material may be about one millimeter thick, or preferably in the range of 0.5 to 2.0 mm in thickness. As will be explained in greater detail later in this disclosure, an important feature of the invention is that the pressure from the can to be resealed actually enhances the sealing function of the seal. As shown in FIG. 5, seal 14 has an upper inwardly extending flange 15 which extends under the lower surface of main cap 12 and gives the seal 14 an inverted L-shape. At the outer radial end of flange 15 a semi-circular or curved bead 31 extends into a correspondingly shaped groove in the material of cap 12 to allow keeping the seal in place just by wedging. When pressure builds up, the flange 15 is actually pushed against the corresponding area of the main cap, whereby enhancing hermetical sealing. This shape of the seal also permits the seal to be removed and replaced, e.g. to wash it thoroughly, by pulling the lower end 16 of the seal radially inward to disengage the seal 14 from the cap 12. As noted above, the seal may be glued, molded or otherwise fixed to the cap.

Figure 6:
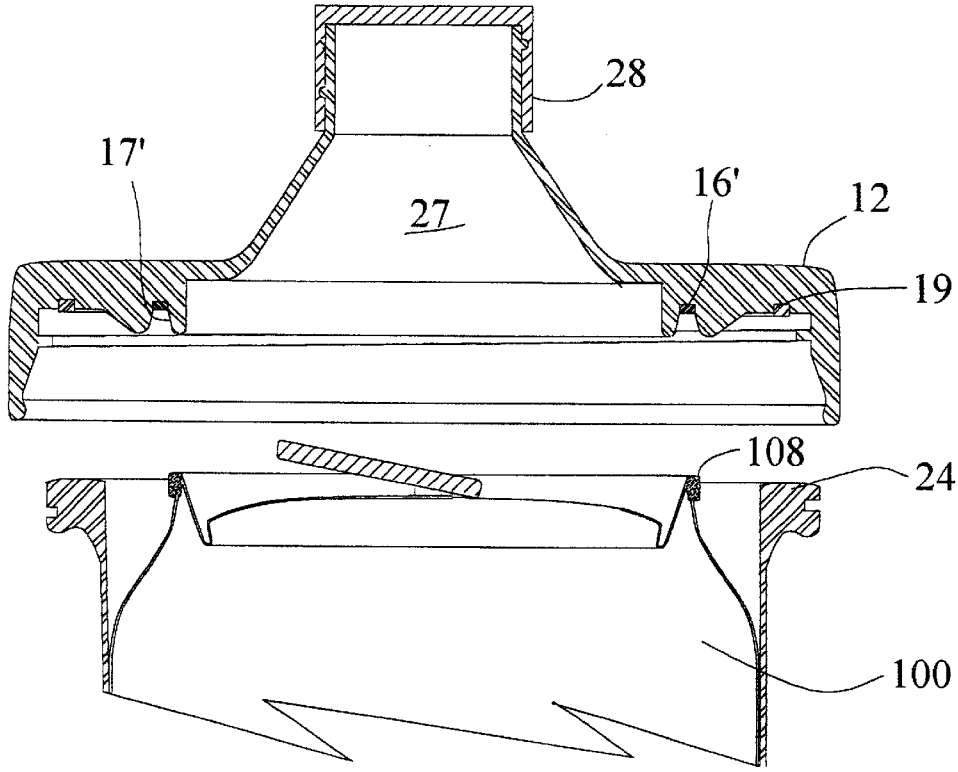
FIG. 6 is a view similar to FIG. 5 of a further embodiment of the invention.

In FIG. 6, a simplified embodiment of the invention is illustrated where the same reference numerals are utilized to designate the same or functionally similar parts. In the embodiment of FIG. 6, the main cap 12 includes an inner annular groove 17', which, at its deepest location, includes a resilient seal member or portion 161 which is positioned or shaped to engage the top of the rim 108 of beverage container 100 when main cap 12 is screwed onto container 24 and actually presses the seal down.

Figure 7A:
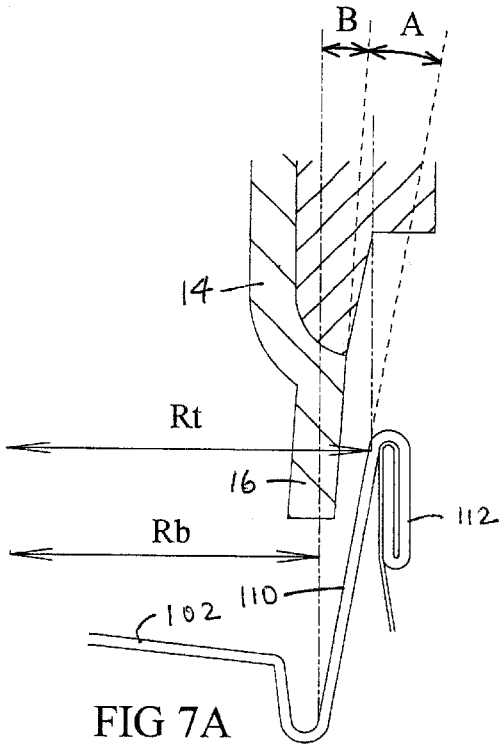
FIG. 7A is a schematic partial and sectional view of the rim area of a beverage can and one embodiment of the seal of the present invention before the main cap has been brought down onto the can, illustrating some principles of the present invention.

Turning now to FIGS. 7A to 7D, in FIG. 7A seal 14 is shown while the main cap (not shown) is still above the beverage container top 102.

FIG. 7A illustrates certain dimensions and parameters of the can geometry which are important for the present invention. This includes the radius Rt which is the radius of the upper end of the inner surface 110 of the can rim 108 inside the groove formed in the top 102 of can 100, adjacent the rim. The radius Rb is the radius of the lower end of the inner surface 110. The space between these two radii is important since the outer sealing surface of the seal portion 16 must substantially lie between these two radii.

Other important landmarks for the present invention include the angle A between the outer surface of the seal 14 and the inner surface 110 of the rim and the angle B between the outer surface of the seal and the central axis of the can. The angle A plus B is the total angle of the inner surface 110 of the can which is typically between 5°–30° and usually about 20° in most commercially available carbonated beverage cans.

For the present invention, the angle A can be as little as 0° where the outer surface of the seal portion 16 is parallel to the inner surface 110 of the can rim 108, or as much as 30° where the inner surface of the sealing portion 16 is substantially parallel to the axis of the can.

In absolute terms, the outer surface of the seal 16 can have an angle B, that is, the angle with the axis of about 0°–30°.

Figure 7B:
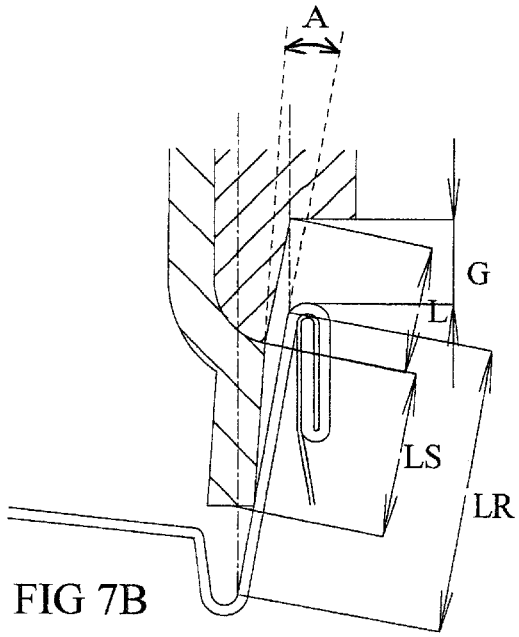
FIG. 7B is a view similar to FIG. 7A with the main cap further down into its final engagement position with the can.

In the preferred embodiment of the seal, the angle A should be around 5°–10°, such that the seal start touching the rim when the cap is not all the way down on the soda can with a gap G of at least 2 mm (as seen in FIG. 7B). This way, there is hermetic sealing even with the gap G and even before any pressure builds, which will be particularly critical in a particular embodiment of the invention described later.

Figure 7C:
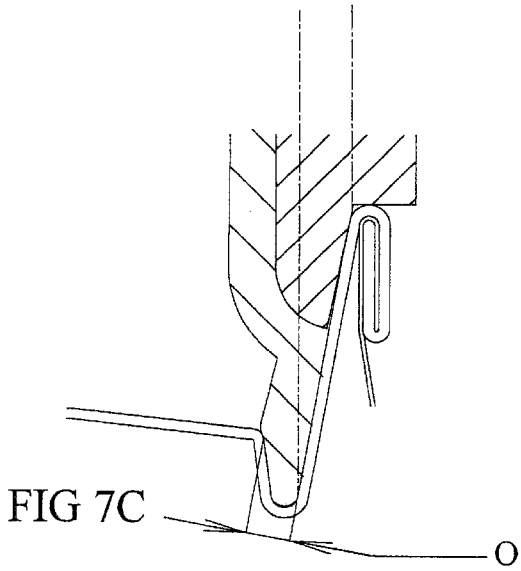
FIG. 7C is a view similar to FIG. 7B of the seal in its fully seated position, but before internal gas pressure has been exerted on the seal.

FIG. 7C shows the fully seated position for the cap. It also shows how the seal is twisted in the bottom groove of the can in the last approximately 2 mm before the cap is fully seated. This provides an additional improvement of the hermetic sealing and will also prevent the main cap from sliding on the soda can in the embodiment of the invention illustrated in FIGS. 8 to 10, when the secondary cap is screwed or unscrewed. Therefore, in the preferred embodiment, at least the end portion of the seal should have a thickness slightly bigger than the groove of the can at its starting point (see O). In the US standard can for Sodas, "O" is approximately 1.1 mm, so the thickness of the seal then can be of 1.1 to 1.3 mm.

Figure 7D:
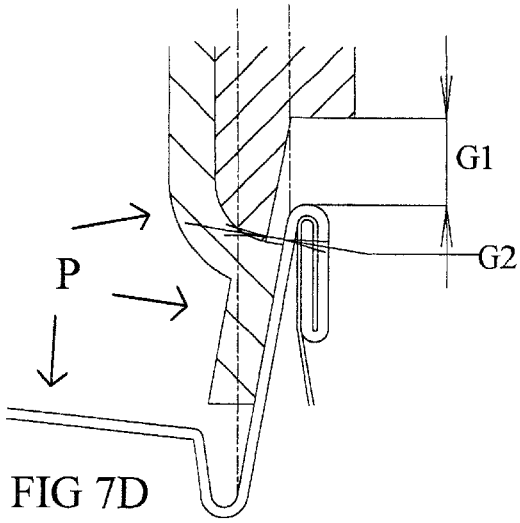
FIG. 7D is a view similar to FIG. 7A of the seal after it has received pressure and the main cap may have been lifted slightly from its fully seated position, but still with the seal avoiding pressure leakage and actually improving the seal by virtue of its receiving pressure from the beverage container.

FIG. 7D shows the main cap in a slight upper position above the soda can, and with pressure P represented by the arrows on the drawing coming into action. The gap G1 corresponds either to manufacturing tolerances of both the can and the present invention, or the flexibility of the plastic material stressed by the force exerted with the pressure, or to a functional gap as, in particular, in the invention of FIGS. 8 to 10 further described, or a combination of all.

As shown in FIG. 7D, the design of the rim of the main cap allows the seal to "naturally" extend laterally, thus allowing the pressure which has an outward component to actually press the sealing portion of the seal more tightly out against the inner surface 110 of the rim. The area of the rim that goes against the rim of the can is preferably parallel to it.

The main function of the rim of the main cap, however, is to prevent the seal from bulging through the gap G1 and lose its function, when the main cap lifts up. Indeed, the rim of the main cap reduces the opening that would be, without the rim, tantamount to G1, into G2, by a coefficient of sine (A), A being the angle defined previously, besides a very small play between the rim of the main cap and the rim of the can to offset can tolerances.

As can be seen on FIG. 7D, this prevents any possibility for the seal to slide out, thus permitting a perfect secured and hermetical sealing, even if the gap G1 is as big as the height of the rim of the main cap, or even slightly bigger.

The depth L of the rim of the main cap and the depth LS of the seal can vary, but in the preferred embodiment the total of L+LS is equal to the depth LR of the rim of the can. In consideration of the maximum lift up of the main cap for any of the different embodiments of the invention which is no more than a fourth of LR, the depth of the rim of the main cap is set in the preferred embodiment at around one third of LR, thus leaving enough sealing area to go against the rim of the can.

Figure 9A:
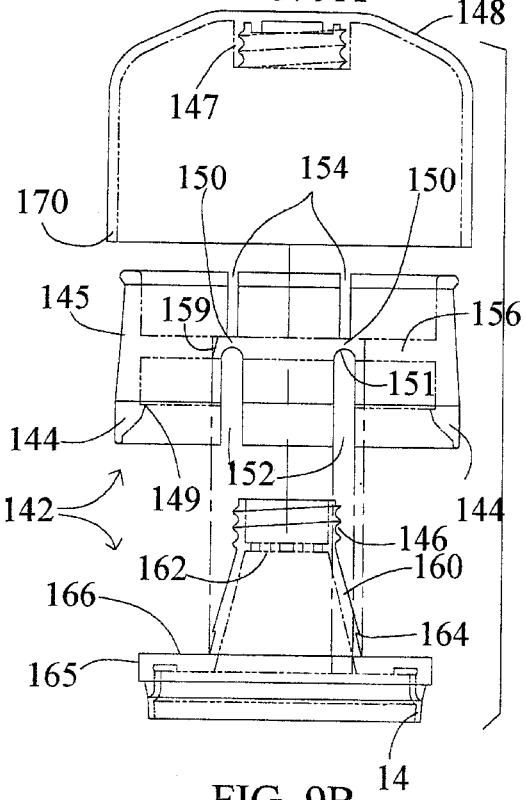
FIG. 9A is an exploded side sectional view of this embodiment showing important features of the present invention.
Figure 9B:
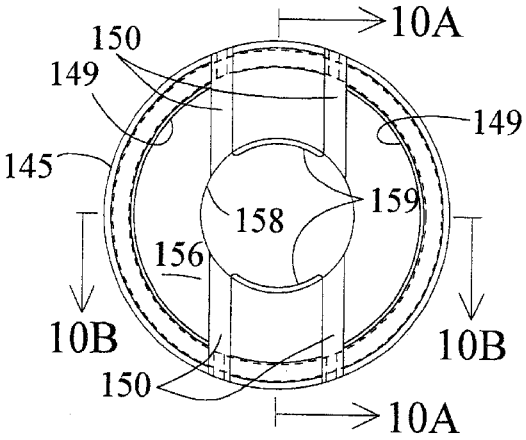
FIG. 9B is a bottom view of the middle of FIG. 9A.
Figure 10A:
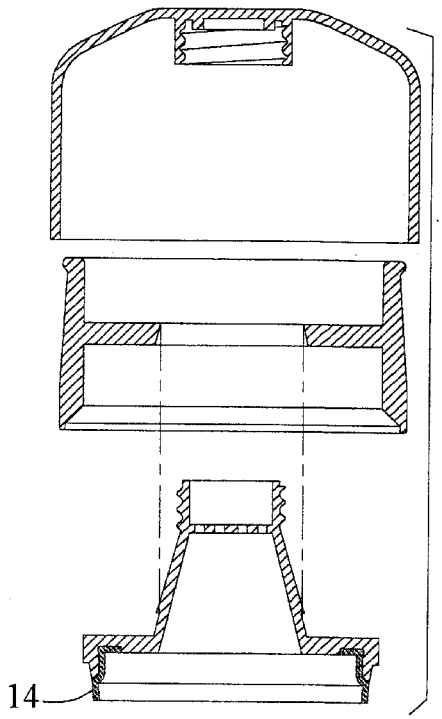
FIG. 10A is an exploded and sectional view of the invention of FIG. 9A, taken in the direction of line 10A—10A in FIG. 9B.

FIGS. 8–10 illustrate a further embodiment of the invention where the invention is meant to engage only the upper end of the can to be resealed. Instead of using hook areas which are relatively short compared to the total circumference of the can rim, as was the case in the prior art of FIG. 11, the inventor has realized that the "hook area" should be extended around the circumference of the can rim as far as possible. In the extreme case, the hook area can be divided into two halves, each extending over one half the can rim. In practice, however, this extreme arrangement entails other constraints and therefore is not considered as the preferred embodiment. In any case, those larger latches require the ability of the main cap to move slightly up and down once hooked onto the can thanks to a functional gap, to permit free engagement and disengagement of the latches, and that while still keeping a hermetical sealing. The seal configuration with the inner rim of the main cap, which was described previously, permits this requirement which is particularly critical to this embodiment of the invention. As an alternative, the present invention utilizes a main cap or lid which has two broad arcuate hook areas that can be articulated with respect to each other to spread the hook areas apart for engaging and disengaging the can. The resiliency of the main cap itself keeps the hook areas together when they are not forcefully spread apart and this, in conjunction with the engagement itself and the pressure from the can, help positively lock the main lid to the can in a manner which can resist pressures generated by soda or beer in cans. Actual tests have revealed that the device can actually withstand pressures of over 140 psi, at which pressure the soda can actually deforms and explodes. This is far more resistence to pressure than would be needed to retain normal carbonation for the purpose of the invention, even in extreme high temperature conditions.

Figure 8A:
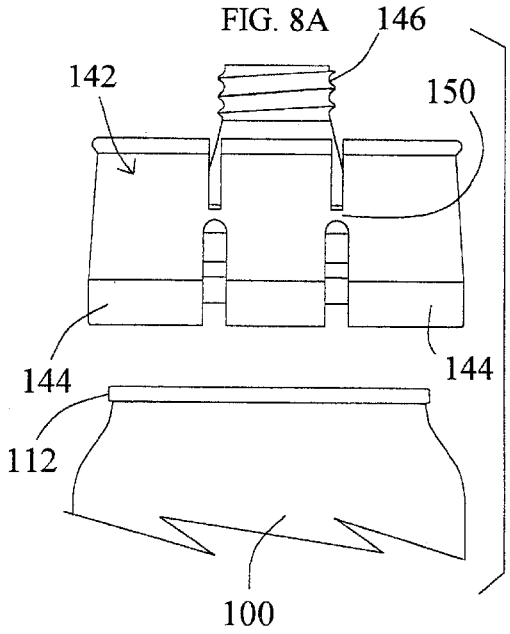
FIG. 8A is an exploded view of one embodiment of the invention and the top of a beverage can before the invention is engaged to the can.

Turning now to FIG. 8A, main cap 142, made of resilient yet strong synthetic material, has a pair of opposite latches 144 which each have inner crescent-shaped hooks designed to engage opposite sides of the can bead 112. A secondary cap 148, shown in FIG. 8C, has an interior thread for engaging over a secondary opening in neck 146 of the main cap 142.

Figure 8C:
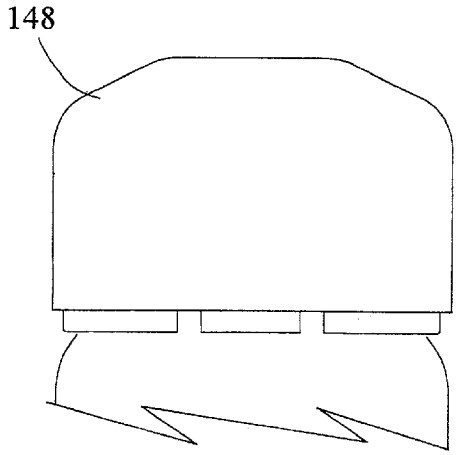
FIG. 8C is a view similar to FIG. 8B with a secondary cap of the invention engaged for further locking the device to the can.
Figure 8B:
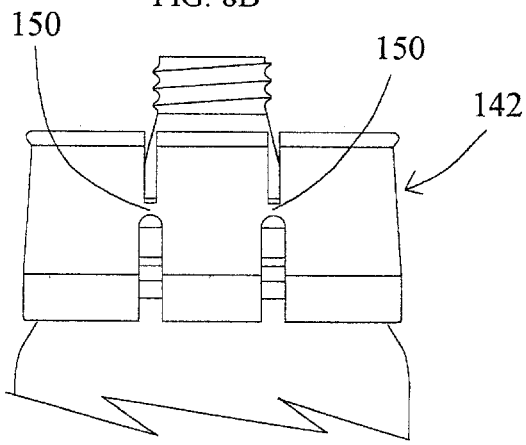
FIG. 8B is a view similar to FIG. 8A, but with the inventive device engaged.
Figure 8D:
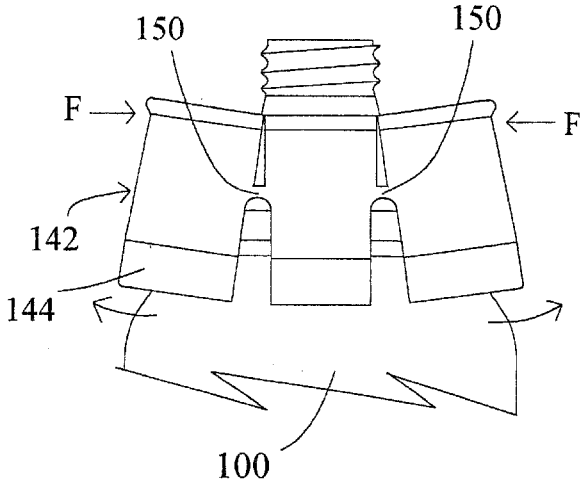
FIG. 8D is a view similar to FIG. 8B showing the position of the device when it is to be disengaged from the can.

Briefly stated, by squeezing the upper end of main cap 142 in the direction of arrows F—F in FIG. 8D, the latches or latch areas 144 spread, allowing the latches to be engaged or disengaged with the can 100. FIG. 8B shows the engaged position for the main cap 142 and FIG. 8C shows how the secondary cap 148 holds the main cap in the locked position, although the secondary cap 148 is not necessary to maintain the lock. Two pairs of live hinges or narrow bridges are shown at 150, and the resiliency of these hinges or bridges, are used to allow pivoting of the latch portions and return of the latch portions to their locked positions (FIG. 8B).

Because of the complexity of the shape of the main cap 142, the inventor has found that it is most economical to make the main cap of two separate parts which are snapped together. This is best illustrated in FIG. 9A. The two-part main cap allows for faster and cheaper mass production of the invention and requires less intricate tooling to manufacture the invention. The two-part structure also permits the selection of more specific plastic which is best suited to each of the functions of the invention; all this, while still keeping the invention as simple to manufacture and use as possible.

As shown in FIG. 9A, each latch portion is provided on a substantially cylindrical latch member 145. As shown in FIG. 9B, the inner circumference of each arcuate latch portion 144 includes an arcuate step or hook 149 that extends around approximately 140° of the circumference of the latch member 145 in the preferred embodiment, on each side of a center line of the member, the center line being well illustrated by line 10A—10A in FIG. 9B. Each latch can be about 90° to about almost 180°. The closer to 180°, the less stress the hook area will get from the load due to the pressure of the soda, since the load is then spread out on a bigger surface area. However, the closer to 180° each hooking area is, the more the two latches have to be squeezed to engage and disengage the can, which becomes "unnatural" at some point. It has been found that 140° is a good compromise between those two previous issues.

Coming back to the extreme case of the hooking area being close to 180°, it is important to note that only one hinge is then used, and consequently only 2 lower slots and two upper slots separate the two latches (not represented on the drawings).

Figure 10B:
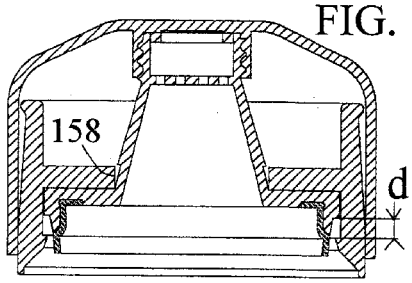
FIG. 10B is a sectional view of the assembled device taken in the direction of line 10B—10B of FIG. 9B.
Figure 11:
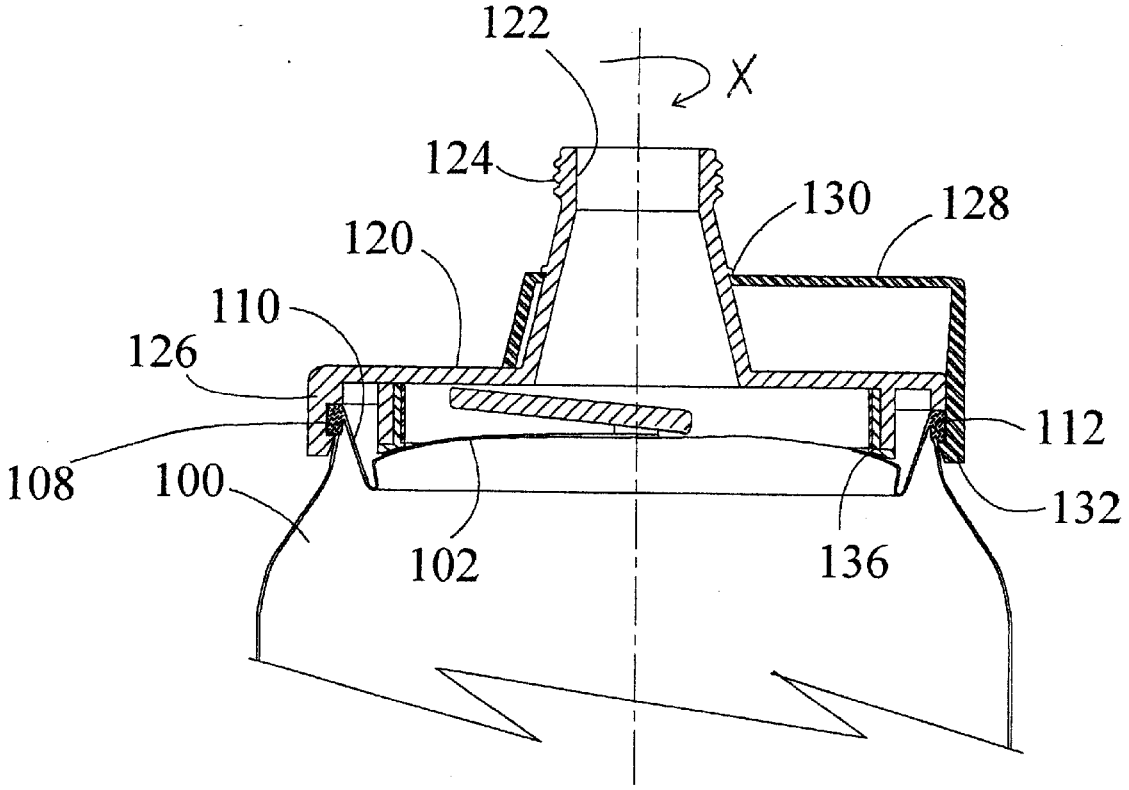
FIG. 11 ( PRIOR ART )
FIG. 11 is a partial sectional view of a prior art device for resealing a soda can.

Another important aspect of the invention is the distance D represented in FIG. 10B, which represents the space in which the bead of the can is so as to hold the main cap to the can. This distance is always more important than the height of the bead of the can so tat to leave a functional gap that is critical to this particular embodiment. The larger the latches are and therefore the closer the hinges are to the center, the bigger this gap has to be. The gap is necessary to permit the engagement and disengagement of the crescent-shaped hooks. Conversely, when the pressure builds up, the seal support member lifts up, thus filling the gap which mechanically prevents the disengagement of the latch. This produces a self-locking effect. To allow the flexing shown at FIG. 8D, the cylindrical portion of the latch member 145 contains four lower slots 152, provided in two pairs on opposite sides of the latch member 145. Grooves 151 are also cut into preferably the lower surface of a transverse platform 156 in the member 145 so that the bridges 150 extend across the entire platform and through the slots 152 to form the live hinges. Narrower upper slots 154 are also provided in two pairs on opposite sides of the latch member 145 and at the upper end of the cylindrical portion. These upper slots allow the latches 144, 144 to flex as shown in FIG. 8D and also limit the flex to what is necessary to engage and disengage the device from the top of the can 5° and not more than 15°, such that it is impossible to overstress the hinge. Bridges 150 are defined within these slots.

As noted, the latch member 145 also includes the platform 156 which contains an aperture 158, shaped to receive a conical projection 160 extending from a seal support member 165, forming the other major portion of the cap 142. Conical projection 160 is substantially hollow and carries, at its upper end, the threaded neck 146.

Figure 10C:
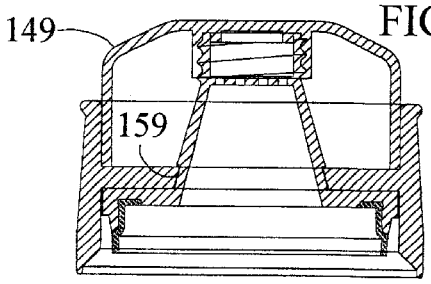
FIG. 10C is a sectional view of a further embodiment of the invention similar to FIG. 10A, but with a smaller secondary cap which also has a locking function.

Secondary cap 148 has a cylindrical skirt dimensioned to engage around the outer surfaces of latch portions 144, and also has in integrally molded threaded cap portion 147 for threadably engaging the neck 146 to hermetically seal the neck closed. A grated partition 162 spans the opening in conical projection 160 and has multiple apertures for passing fluid, but for preventing insects, of instance, to pass through. The outer surface of projection 160 includes an annular step 164 which is spaced above an upper flat surface 166 of the seal support member 165, by a distance which is about the same as the thickness of platform 156. Aperture 158 in platform 156 has a pair of conical inner surface portions 159 which taper inwardly in an upward direction and are shaped to resiliently slide over the outer surface of conical projection 160 and snap lock under step 164. The remaining circumference of opening 158 is cylindrical so that both areas of the platform outside of the hinges can move up freely when the latches are operated. For better understanding of the engagement between the two parts of the main cap 142, the cylindrical portion of the opening 158 is shown in FIG. 10B, while the conical portions 159 and their close engagement around the base of projection 160 and under the step 164 is shown in FIG. 10C.

FIG. 10B also illustrates how the inner surface of the skirt of secondary cap 148 closely embraces the outer surfaces of latch portions 144 to keep the latch portions locked inwardly toward the rim of the can (not shown in these figures). An alternate embodiment is shown in FIG. 10C where a smaller secondary cap 149, having a skirt which extends against the inner surface of the upper portion of latch member 145, is utilized to keep the upper portions from being moved inwardly in the direction of arrows F—F of FIG. 8D. This also serves to keep the latch members in their locked positions.

As previously explained, the latch member 145 is the only part which bears heavy mechanical constraints. One the FDA approved synthetic material that can be used is DELRIN, which has good rigidity and yet sufficient resiliency for the hinges. This material also has good dimensional stability in environment both cold and containing moisture, which is important since the device can be used in a fridge.

The seal support member and the secondary cap can be made in a much wider range of synthetic materials, as long as they are FDA approved, such a polypropylene plastics, which are inexpensive.

As with the other embodiments of the invention, seal 14 is made of a separate member of resilient material. Alternatively, the seal support member 165 may be manufactured with an integrally formed seal 14 made of the same material, but much thinner than the rest of the member 165 to achieve the seal function.

As with the other embodiments of the invention, part of the device can be shaped for use as a lever to engage under the tab of the can. For example, the bottom edge 170 of the skirt of secondary cap 148 can serve this function.

Figure 12:
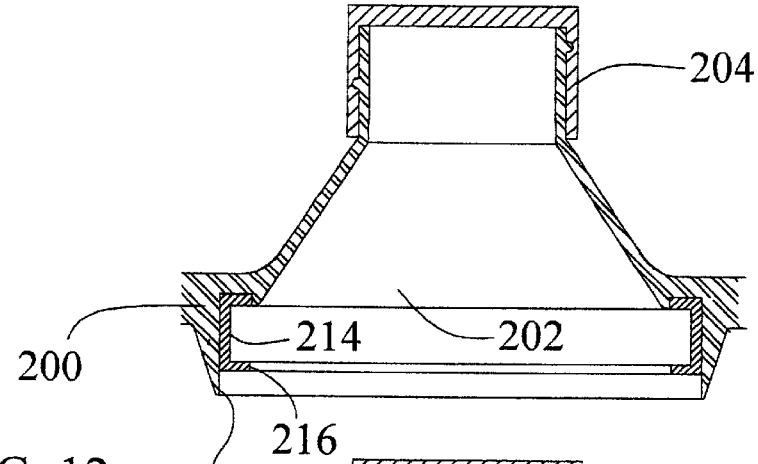
FIG. 12 is a schematic simplified view of an alternate seal arrangement of the present invention.
Figure 13:
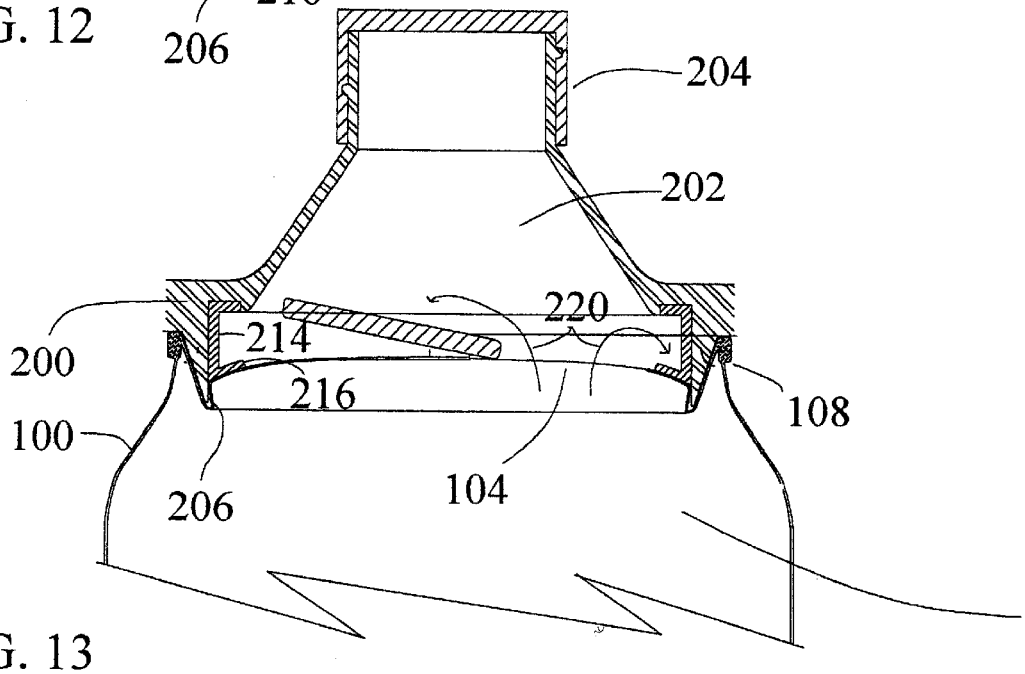
FIG. 13 is a view of the embodiment of FIG. 12 engaged to a beverage container.

FIGS. 12 and 13 illustrate a still further embodiment of the invention. In this embodiment the main cap 200 can be engaged to the beverage container 100 in any mechanism already disclosed, for example using latch means for engaging the upper end of the container or in conjunction with an outer container for enclosing the beverage container. As with the other embodiments of the invention, main cap 200 includes an opening 202 therethrough, which itself is closed by a secondary cap 204.

The seal 214 of the embodiment of FIGS. 12 and 13, includes an annular, flexible sealing portion 216 which is positioned and shaped, just as the sealing portion 16 in other embodiments of the invention, so that pressure from beverage container 100 actually presses the sealing portion 216 more firmly against part of the beverage container for sealing the container. Main cap 200 also includes a rim 206 adapted to fit into the groove of the top of the can, as seen in FIG. 13, when the main cap is all the way down on the can. Rim 206 is such that it prevents the seal 214 and its portion 216 from sliding out with the pressure, even when the main cap possibly slightly lifts up due to the build up of the pressure. In the embodiment of FIGS. 12 and 13, sealing portion 216 is forcefully pressed down against the upper surface of container 100, in the direction of arrows 220.

Figure 14:
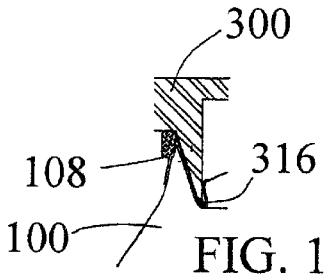
FIG. 14 is a partial schematic representation of a still further embodiment of the invention.
Figure 15:
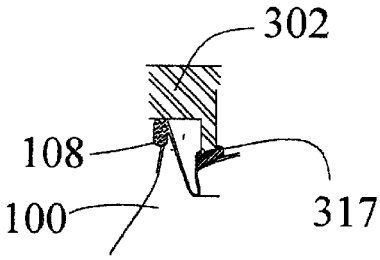
FIG. 15 is a view similar to FIG. 14 of a still further embodiment of the invention.

In the embodiment of FIG. 14, which is similar to the embodiment of FIG. 6, a simple pressure seal 316 is pressed down by main lid 300, into the groove between the top and rim 108 of beverage container 100. FIG. 15 shows a similar construction where seal 317 is pressed down by main cap 302, on to the top of beverage container 100. In both of the embodiments of FIGS. 14 and 15, a further container not shown in the figures receives beverage container 100 and mates with the main lid 300 or 302 to firmly hold the main lid to the beverage container.

While specific embodiments of the invention have been shown and described in detail to illustrate the application of the principles of the invention, it will be understood that the invention may be embodied otherwise without departing from such principles.

What is claimed is:

1. An arrangement for resealing a pressurized beverage can having a top with an aperture that can be opened to discharge a beverage from the can, the arrangement comprising:

a main cap for engagement over the beverage can top for covering the beverage can top;

an enclosure having an open top for receiving the beverage can, and engagement means between the main cap and the enclosure for removable fixing the main cap to the enclosure with sufficient force to resist pressure from, and to maintain pressure in the beverage can;

an annular seal member hermetically connected to the main cap and extending toward the beverage can when the main cap is over the beverage can and is removably fixed to the enclosure, the seal member having a flexible and resilient pressure sealing portion adapted to engage against and hermetically seal with the beverage can top, for resealing the aperture;

an opening through the main cap for discharging beverage from the beverage can when the can is in the enclosure; and a secondary cap removable engaged with the main cap for closing the opening through the main cap with sufficient force to resist pressure from, and to maintain pressure in the beverage can.

2. An arrangement according to claim 1, including means for insulating the enclosure.

3. An arrangement according to claim 1, wherein the beverage can includes a tab for opening the top of the beverage can, the main cap including a portion with an edge shaped to engage under the tab to help lift the tab and open the beverage can.

4. An arrangement according to claim 1, wherein the annular sealing portion extends downwardly and inwardly with respect to the main cap.

5. An arrangement according to claim 1, wherein the annular sealing portion is positioned to engage into a groove around the top of the beverage can and against the inner surface of a rim of the beverage can.

6. An arrangement for resealing a beverage container having a top with an aperture that can be opened to discharge the beverage, and a rim with an inner surface, around the top, the arrangement comprising:

a main cap for engagement over the beverage container top for covering the beverage container top;

a seal member hermetically connected to the main cap and extending toward the beverage container top when the main cap is over the beverage container top, the seal member having a sealing portion adapted to engage against and hermetically seal with the beverage container;

an enclosure having an open top for receiving the beverage container, with engagement means between the main cap and the enclosure for removable fixing the main cap to the enclosure with sufficient force to resist pressure from, and to maintain pressure in the beverage container;

an opening through the main cap for discharging beverage from the beverage container; and a secondary cap removable engaged with the main cap for closing the opening through the main cap with sufficient force to resist pressure from, and to maintain pressure in the beverage container.

7. An arrangement according to claim 6, wherein the enclosure is insulated.

8. An arrangement according to claim 7, wherein the engagement means comprises a thread engagement between the main cap and the enclosure.

9. An arrangement according to claim 8, wherein the sealing portion is annular and is positioned to engage into a groove on the top of the beverage container which is at the base of the inner surface of the rim.

10. An arrangement according to claim 8, wherein the sealing portion is annular and is positioned to engage against the top of the beverage container at a location inwardly of the inner surface of the rim.

11. An arrangement according to claim 1, wherein the main cap includes a groove for receiving the seal portion, the can having a rim for engaging against the seal portion when the main cap is connected to the enclosure with the can in the enclosure.

* * * * *